US007201587B1

(12) United States Patent
Eichorn et al.

(10) Patent No.: US 7,201,587 B1
(45) Date of Patent: Apr. 10, 2007

(54) ELECTRICAL CONNECTOR WITH RIGHT ANGLE TERMINAL PINS

(75) Inventors: Daniel S. Eichorn, El Paso, TX (US); Steven W. Marzo, Cortland, OH (US); James M. Stambolia, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/496,682

(22) Filed: Jul. 31, 2006

(51) Int. Cl.
*H01R 12/00* (2006.01)

(52) U.S. Cl. ..... 439/79

(58) Field of Classification Search ..... 439/79, 439/80

See application file for complete search history.

(56) References Cited

U.S. PATENT DOCUMENTS 6,116,920 A * 9/2000 Yu et al. ..... 439/79
6,702,593 B2 * 3/2004 Ogawa ..... 439/79

* cited by examiner

*Primary Examiner*—Tho D. Ta
(74) *Attorney, Agent, or Firm*—David P. Wood

(57) ABSTRACT

An electrical connector has a connector body. A pin block disposed in the connector body supports a plurality of terminal pins that are arranged in horizontal rows that are vertically spaced with the terminal pins in each row being laterally spaced from each other. The terminal pins have contact portions projecting out a forward end of the pin block and tail portions projecting out a rearward end of the pin block. The tail portions of the terminal pins in an uppermost row of the plurality of terminal pins have straight tail portions. The connector body has a socket at a forward end, an intermediate retainer section holding the pin block and a tail guard at a rearward end for protecting the projecting tail portions of the terminal pins. The tail guard has a top wall that includes an aft portion that is behind pin block and that is raised to accommodate elastic bending of the straight tail portions of the terminal pins in the uppermost row upward to an inclined position by a sufficient amount so that the subsequent over bending of the straight tail portions downwardly in situ forms an acute angle in the straight tail portions thus providing perpendicular tail ends for connection to a printed circuit board while maintaining a low profile of the intermediate retainer section that houses the pin block and the socket.

16 Claims, 4 Drawing Sheets

20
14
60
61
57
12
56

10
59
58
1A
1A
58
12
14
57
16

ELECTRICAL CONNECTOR WITH RIGHT ANGLE TERMINAL PINS

BACKGROUND OF THE INVENTION

This invention relates generally to an electrical connector that has right angle terminal pins for attachment to a printed circuit board and to a process for making such an electrical connector.

SUMMARY OF THE INVENTION

An electrical connector and process in which a plurality of terminal pins are disposed in a connector body that has a tail guard for projecting tail portions of the terminal pins. The tail guard is shaped to accommodate in situ over bending of projecting tail portions of the terminal pins.

DETAILED DESCRIPTION OF THE PREFERRED EMBODIMENTS

Figures 1, 1A:
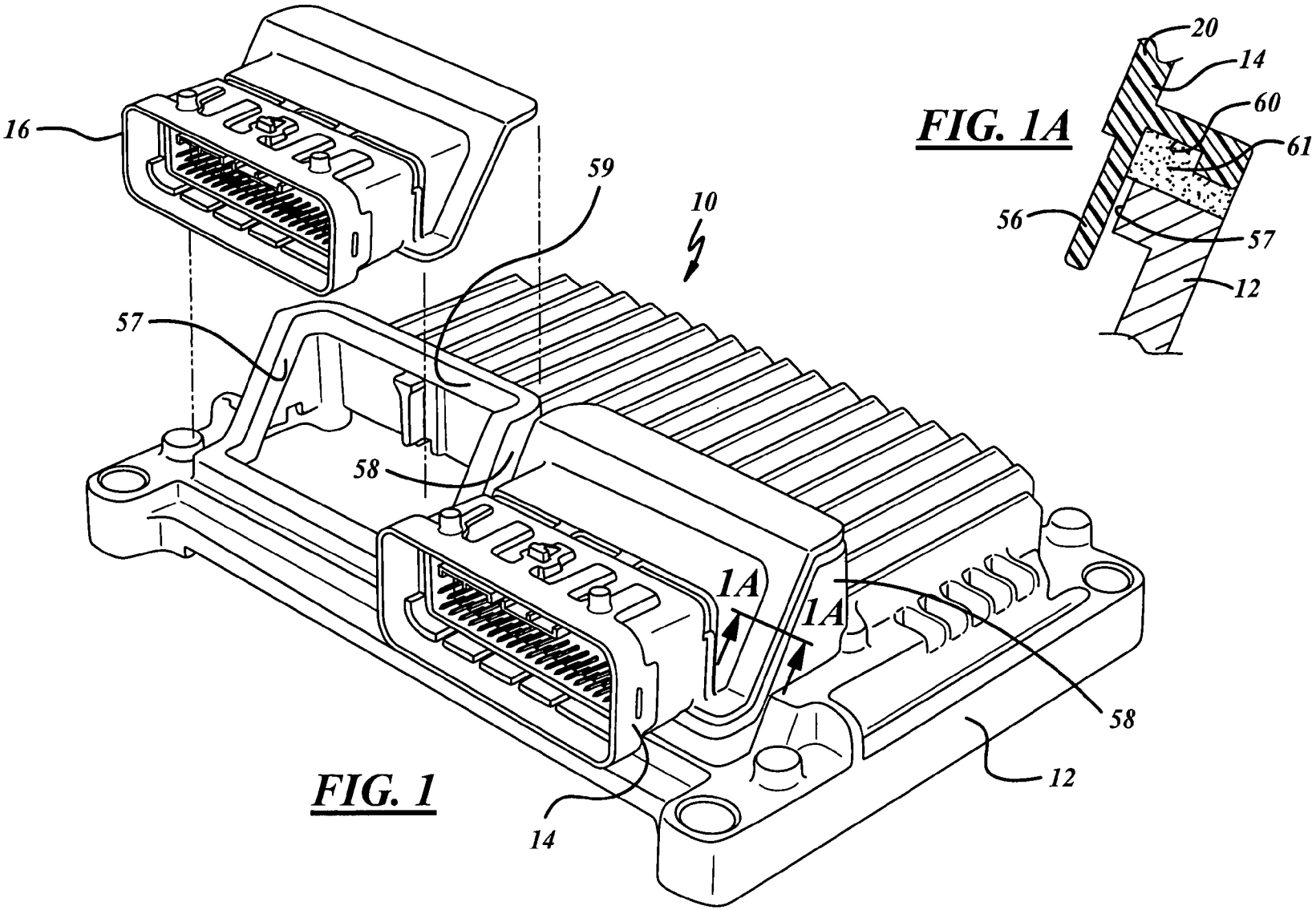
FIG. 1 is a perspective view of an electronic assembly having an electrical connector illustrating a preferred embodiment of the invention.
FIG. 1A is a section taken substantially along the line 1A—1A of FIG. 1 looking in the direction of the arrows.

Referring now to the drawing, electronic assembly 10 comprises a two piece die cast aluminum housing 12 having an upper housing part or cover 13 upon which are mounted two identical electrical connectors 14 and 16, each of which illustrate an identical preferred embodiment of the invention. The typical electrical connector 14 may be used to connect a printed circuit board 18 inside housing 12 with a wiring harness (not shown) which typically includes an electrical connector (not shown) that plugs into electrical connector 14.

Electrical connector 14 comprises a connector body 20, a pin block 22 that supports a plurality of insert molded terminal pins 24, a seal 26, a terminal stabilizer 28 and a pin alignment member 30.

Figure 3:
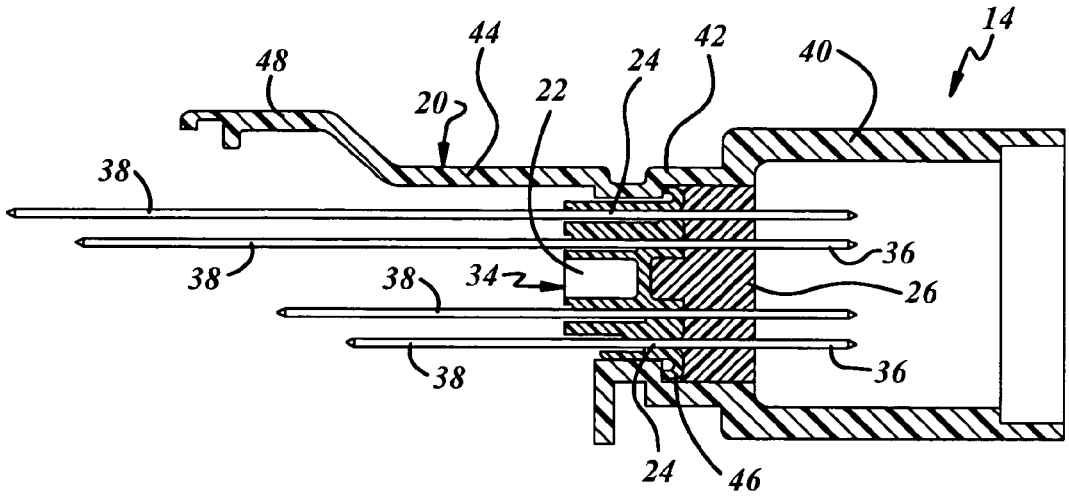
FIGS. 3, 4, 5 and 6 are sections of the electrical connector shown in FIGS. 1 and 2 showing various stages of manufacture.

Pin block 22 is a molded thermoplastic body that acts as an insulator to space terminal pins 24 and isolate the terminal pins 24 from each other electrically. Typically the terminal pins 24 are arranged in horizontal rows that are vertically spaced with the terminal pins 24 in each row being laterally spaced from each other. The embodiment illustrated in the drawing has four horizontal, vertically spaced rows of terminal pins 24. The terminal pins 24 are originally straight and arranged in a suitable fixture. The properly arranged terminal pins 24 are then insert molded in pin block 22 in a well know manner to produce a terminal block assembly 34 having contact portions 36 of the terminals pins 24 projecting out one end of the pin block 22 and tail portions 38 projecting out the opposite end of the pin block 22 as best shown in FIG. 3. Starting from the bottom row the tail portions 38 are progressively longer with each succeeding horizontal row so that the tips are substantially co-planar when the tail portions 38 are bent at a right angle for connection to the printed circuit board 14, as explained below.

The connector body 20 is a shell having a socket 40 at a forward end for receiving a mating connector on the end or a wiring harness (not shown). Connector body 20 includes an intermediate annular retainer section 42 for holding the pin block assembly 34 and a rearward tail guard 44 at the opposite end for protecting the projecting tail portions 38 of the terminal pins 24 in the pin block assembly 34. During manufacture, the terminal block assembly 34 is inserted into the intermediate retainer section 42 through the socket 40 and located by a flange 46 of pin block 22 that engages an internal shoulder of the connector body 20. The peripheral wall of pin block 22 may have an asymmetrical arrangement of longitudinal ribs that are received in matching slots in socket 40 to assure that the pin block assembly 34 is properly inserted into socket 40. This is a well known conventional orientation technique and consequently the longitudinal ribs and slots are not shown.

When properly located in the retainer section 42, withdrawal of the pin block assembly 34 out through the socket 40 is prevented by a friction fit of pin block 22 in retainer section 42. The peripheral wall of pin block 22 may have a plurality of shallow ribs (not shown) that are used to force fit pin block 22 in retainer section 42.

Figure 4:
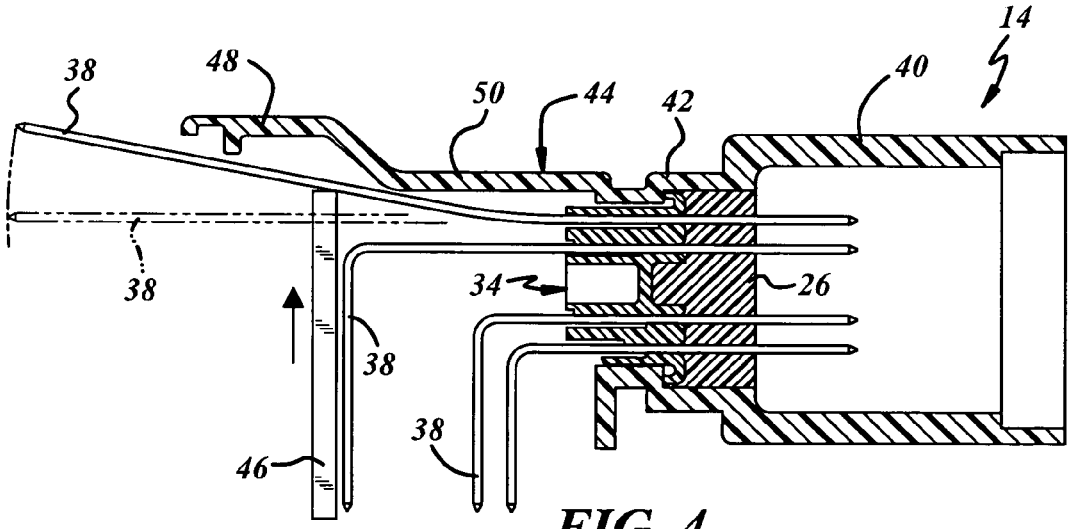

After the terminal block assembly 34 is assembled and held in the connector body 20, the projecting tail portions 38 shown in FIG. 3 are permanently bent at a right angle one row at a time, starting with the lowest row. The electrical connector 14 shown in the drawing has four horizontal, vertically spaced rows of terminal pins 24. FIG. 4 shows the projecting tail portions 38 of the three lower rows permanently bent at a right angle with their tips substantially co-planar.

Terminal pins 24 are made of a material, such as cartridge brass having a nickel underplate and a gold or lead free tin coating, that has spring back characteristics when tail portions 38 are permanently bent. Consequently the tail portions 38 are over bent, that is, the tail portions 38 are bent at a slightly acute angle that is more than a right angle, for instance at an angle of about 15 degrees. Consequently the tail portions 38 are disposed substantially at a right angle after the tail portions 38 are over bent and spring back. Over bending the tail portions 38 of the bottom three rows of terminal pins 24 in situ is usually not a problem because there is ample space for tooling to operate in the rearward tail guard 44 behind pin block assembly 22. However, the electrical connector 14 also provides ample space for over bending the projecting tail portions 38 of even the highest row of terminal pins 24 in situ, which in this particular instance is the fourth row of terminal pins 24.

Figure 5:
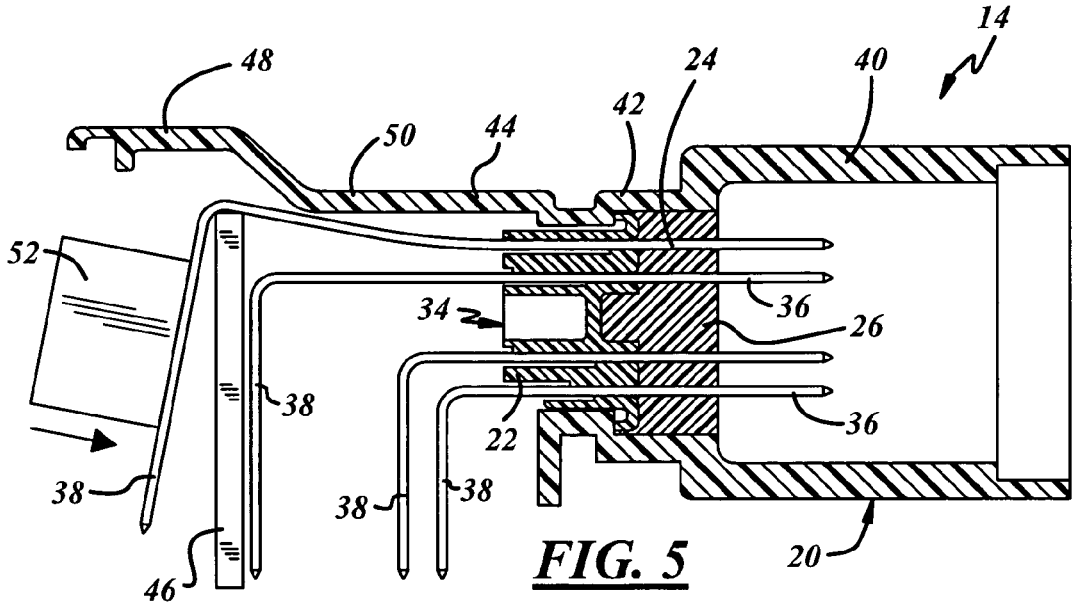
Figure 6:
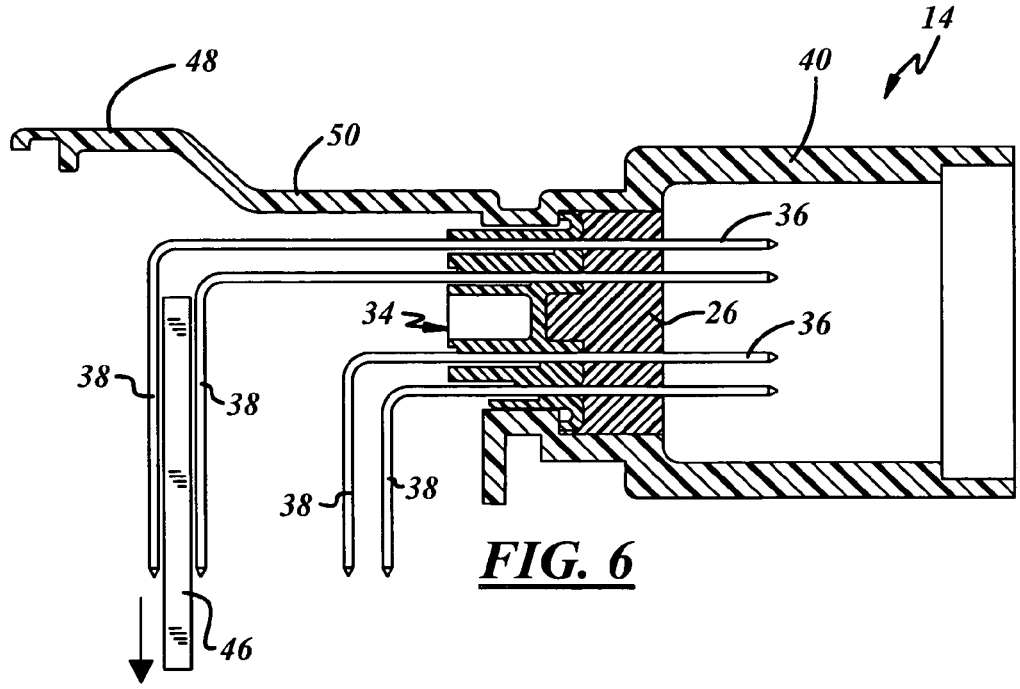

The process for over bending the tail portions 38 in the highest row of terminal pins 24 is illustrated in FIGS. 4, 5 and 6. The projecting tail portions 38 in the highest terminal row are first bent up elastically from a horizontal position (shown in dashed lines) to an upwardly and rearwardly inclined position (shown in solid lines) by a suitable tool such as a vertically moveable blade 46 that is shown in FIG. 4. In this regard, it should be noted that the aft portion 48 of the top wall 50 of the rearward tail guard 44 that is behind pin block 22 is raised with respect to the forward portion which is more or less an extension of the top wall of the intermediate retainer section 42, as best shown in FIGS. 2–5, to accommodate this initial elastic bend. The raised aft portion 48 of the top wall 50 maintains the low profile of the remainder of the connector body 20, particularly the intermediate retainer section 42 that houses the pin block 22 and the socket 20 that receives the mating connector of the wiring harness (not shown).

As indicated above, the tail portions 38 are initially bent up elastically to the inclined position shown in solid lines in FIG. 4. Then a second pivotally moveable tool 52 engages the end parts of the tail portions 38 aft of the blade 46 over bending these parts deforming the tail portions 38 around the top of blade 46 with the bend exceeding a right angle as best illustrated in FIG. 5. As indicated above, this bend is at a slightly acute angle of about 15 degrees.

After the tail portions 38 are over bent by tool 52 and tool 52 is withdrawn, the over bent tail portions 38 spring back to substantially a right angle. Blade 46 is then withdrawn so that the elastically bent-up tail portions ahead of the bend are released and return to a horizontal position as shown in FIG. 6. The aft portion 48 of top wall 50 is raised by a sufficient distance so that the tail portions 38 spring back to substantially a right angle after being over bent. This distance varies depending on the geometry of the parts and the material of the terminal pins 24.

Seal 26 is preferably formed in situ, that is, a suitable sealing material is dispensed and cured in place on the contact side of the pin block 22 after the terminal block assembly 34 is installed. Such a seal is particularly advantageous in the case of square terminal pins 24, such as those illustrated in FIGS. 2–6. Seal 26 may be formed in situ either before or after the tail portions 38 of the terminal pins 22 are permanently bent at a right angle.

As indicated above, electrical connector 14 preferably includes a terminal stabilizer 28. Terminal stabilizer 28 has a flange 30 that is inserted into the socket 40 after the seal 26 is cured. Terminal stabilizer 28 includes a plurality of holes that receive the respective protruding contact portions 36 of the terminal pins 24 to align the contact portions 36 of the terminal pins 24 for proper mating engagement with female terminals carried by the mating electrical connector of a wiring harness (not shown). With the optional pin stabilizer 28 in place, electrical connector 14 is now ready for attachment to cover 13 of housing 12.

Connector body 20 has a peripheral mounting flange 56 that fits inside one of two openings 57 in cover 13, the openings 57 each being defined in part by trapezoidal side walls 58 and a raised back wall 59. Connector body 20 has a continuous groove 60 outside the peripheral mounting flange 56 for receiving an adhesive 61. Connector body 20 is attached to cover 13 filling groove 60 with an adhesive 61 and inserting mounting flange 56 into opening 57 of cover 13 so that the adhesive glues or bonds the connector body 20 to the portions of the aluminum die case cover 13 adjacent to the opening 57.

Figure 2:
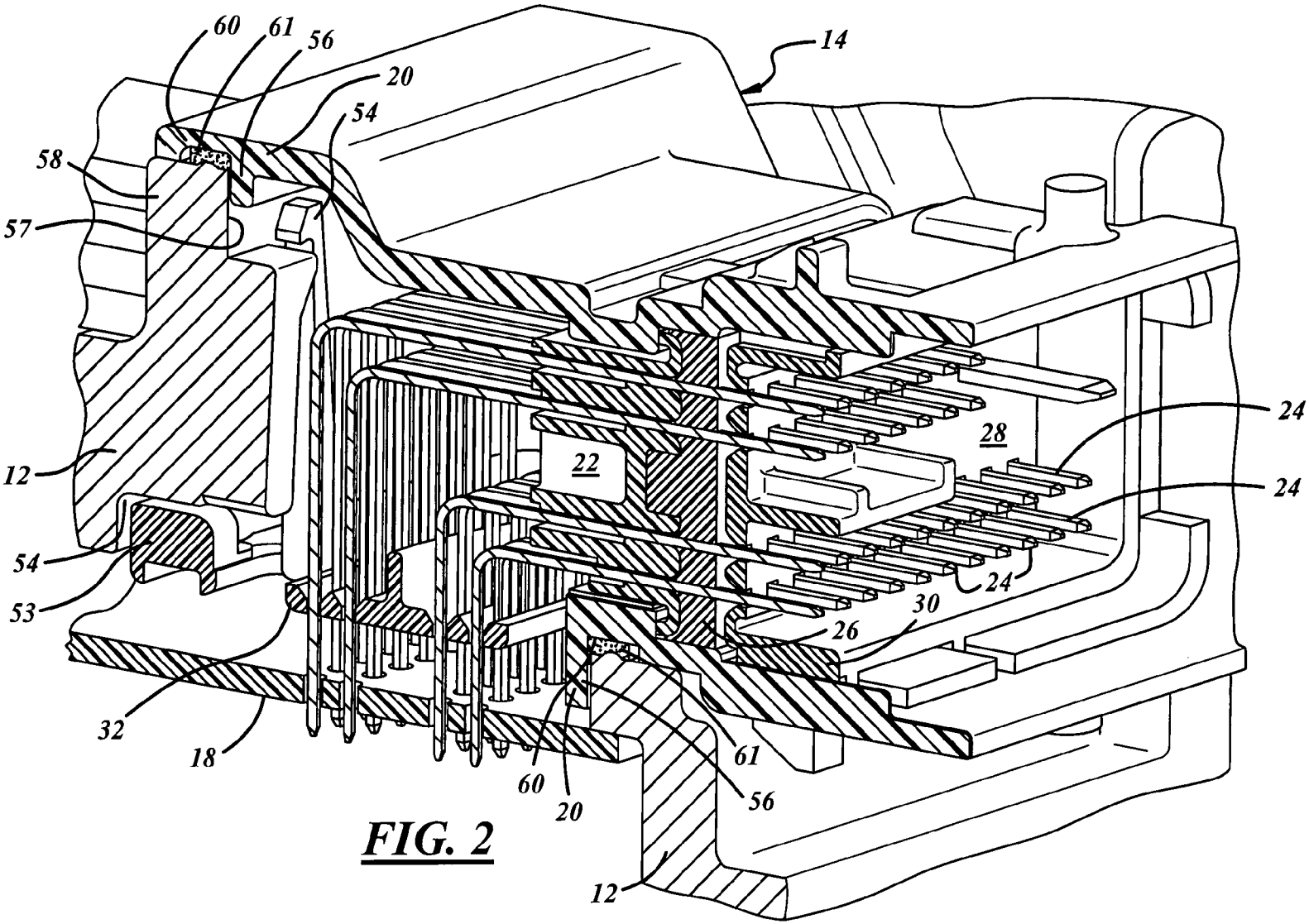
FIG. 2 is a sectioned perspective view of the electrical connector shown in FIG. 1.

After connector body 20 is attached to cover 13, the vertical parts of the bent tail portions 38 of all the terminal pins 22 are inserted through holes in pin alignment member 32. The pin alignment member 32 is then pushed up into cover 13. The pin alignment member 32 includes a plurality of alignment features 53 (one shown) that engage alignment cavities 54 in cover 13 and a pair of latch arms 54 (one shown) that engage an internal latch shoulder of cover 13 to hold the pin alignment member 32 in the proper position in the cover 13 as shown in FIG. 2. The pin alignment member 32 aligns the vertical parts of projecting tail portions 38 precisely for insertion into holes of the printed circuit board 18 as shown in FIG. 2.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector comprising;

a connector body, a pin block disposed in the connector body, the pin block supporting a plurality of terminal pins that are arranged in horizontal rows that are vertically spaced with the terminal pins in each row being laterally spaced from each other, the terminal pins having contact portions projecting out a forward end of the pin block and tail portions projecting out a rearward end of the pin block, the tail portions of the terminal pins in an uppermost row of the plurality of terminal pins having straight tail portions, the connector body having a socket at a forward end for receiving a mating connector, an intermediate retainer section for holding the pin block and a rearward tail guard for protecting the projecting tail portions of the terminal pins, the tail guard having a top wall that includes an aft portion that is behind the pin block and that is raised with respect to the top wall to accommodate an elastic bending of the straight tail portions of the terminal pins in the uppermost row upward and rearwardly by a sufficient amount for the subsequent over bending of the straight tail portions in situ to form an acute angle in the straight tail portions while maintaining a low profile of the intermediate retainer section that houses the pin block and the socket that receives the mating connector.

2. The electrical connector of claim 1 wherein the straight tail portions of the terminal pins in the uppermost row project outwardly of the tail guard.

3. The electrical connector of claim 1 wherein the pin block supports a plurality of insert molded terminal pins to form a terminal block assembly that has the contact portions of the terminals pins projecting out the forward end of the pin block and the tail portions projecting out the rearward end of the pin block, the terminal block assembly being insertable into the intermediate retainer section through the socket and located by the pin block abutting an internal shoulder of the connector body, and starting with the tail portions of the terminal pins in a lowermost row of the plurality of terminal pins, the tail portions being progressively longer with each succeeding horizontal row so that the tail portions have tips that are substantially co-planar when the tail portions are bent at a right angle for connection to a printed circuit board.

4. The electrical connector of claim 3 wherein the electrical connector further includes a seal that is molded in situ in the connector body ahead of the pin block and wherein the electrical connector further includes a terminal stabilizer ahead of the seal with the contact portions of the pin terminals projecting through holes in the terminal stabilizer.

5. The electrical connector of claim 4 wherein the terminal pins are square.

6. The electrical connector of claim 4 wherein the electrical connector includes a pin alignment member with the tail portions of the pin terminals projecting through holes in the pin alignment member.

7. An electrical connector comprising;

a connector body, a terminal block assembly having a pin block disposed in the connector body, the pin block supporting a plurality of terminal pins that are arranged in horizontal rows that are vertically spaced with the terminal pins in each row being laterally spaced from each other, the terminal block assembly having contact portions of the terminals pins projecting out a forward end of the pin block and tail portions projecting out a rearward end of the pin block, the tail portions of the terminal pins in an uppermost row of the plurality of terminal pins having straight tail portions, the connector body having a socket at a forward end for receiving a mating connector, an intermediate retainer section for holding the pin block and a tail guard at a rearward end for protecting the projecting tail portions of the terminal pins, the tail guard having a top wall that includes an aft portion that is behind the pin block and that is raised with respect to the top wall to accommodate an elastic bending of the straight tail portions of the terminal pins in the uppermost row upward from a horizontal position to an indicated position by a sufficient amount for the subsequent over bending of the straight tail portions when in the inclined position to form an acute angle in the straight tail portions while maintaining a low profile of the intermediate retainer section that houses the pin block and the socket that receives the mating connector.

8. The electrical connector of claim 7 wherein the terminal block assembly is insertable into the intermediate retainer section through the socket and located by a flange of pin block that engages an internal shoulder of the connector body, and starting with the tail portions of the terminal pins in an lowermost row of the plurality of terminal pins, the tail portions being progressively longer with each succeeding horizontal row so that the tail portions have tips that are substantially co-planar when the tail portions are bent at a right angle for connection to a printed circuit board.

9. The electrical connector of claim 8 wherein the terminal pins are square and wherein the electrical connector further includes a seal that is molded in situ in the connector body ahead of the pin block.

10. The electrical connector of claim 9 wherein the electrical connector further includes a terminal stabilizer ahead of the seal with the contact portions of the pin terminals projecting through holes in the terminal stabilizer.

11. The electrical connector of claim 10 wherein the electrical connector includes a pin alignment member with the tail portions of the pin terminals projecting through holes in the pin alignment member.

12. A process for making an electrical connector comprising;

providing a connector body having a socket at a forward end for receiving a mating connector, an intermediate retainer section for holding a pin block and a tail guard at a rearward end for protecting projecting tail portions of terminal pins supported by the pin block, the tail guard having a top wall that includes an aft portion that is behind the pin block and that is raised with respect to the top wall, inserting a terminal block assembly into the intermediate retainer section through the socket, the terminal block assembly having the pin block supporting a plurality of terminal pins that are arranged in horizontal rows that are vertically spaced with the terminal pins in each row being laterally spaced from each other, the terminal pins having contact portions projecting out a forward end of the pin block and tail portions projecting out a rearward end of the pin block with the tail portions of the terminal pins in an uppermost row of the plurality of terminal pins having straight tail portions, bending the straight tail portions of the terminal pins in the uppermost row up elastically from a horizontal position to an inclined position, and over bending the tail portions of the terminal pins in the uppermost row down to form an acute angle in the tail portions while the tail portions are held in the inclined position, and releasing the tail portions from the inclined position so that the tail portions are permanently bent at substantially a right angle with tail portions ahead of the bends in the horizontal position.

13. The process as defined in claim 12 wherein the straight tail portions of the terminal pins in the uppermost row are bent up elastically from the horizontal position to the inclined position by a vertically moveable blade, and wherein the tail portions of the terminal pins in the uppermost row are bent down to form an acute angle in the tail portions by a pivotally mounted tool while the tail portions are held in the inclined position by the vertically moveable blade, and wherein the tail portions are released from the inclined position by retracting the vertically moveable blade so that the tail portions ahead of the bend return to the horizontal position.

14. The process as defined in claim 13 wherein a seal is formed in situ by a suitable sealing material being dispensed and cured in place in the connector body adjacent a forward end of the pin block after the terminal block assembly is installed.

15. The process as defined in claim 14 wherein a pin stabilizer having a plurality of holes is inserted into the socket after the seal is formed, so that the pin stabilizer receives the respective protruding contact portions of the terminal pins in the plurality of holes respectively to align the contact portions of the terminal pins for proper mating engagement with female terminals carried by the mating electrical connector of a wiring harness.

16. The process as defined in claim 14 wherein the connector body is attached to a housing member and the vertical parts of the bent tail portions of all the terminal pins are inserted through holes in a pin alignment member that is pushed up into the housing member.

* * * * *